United States Patent [19]

Batra et al.

[11] 4,311,522

[45] Jan. 19, 1982

[54] COPPER ALLOYS WITH SMALL AMOUNTS OF MANGANESE AND SELENIUM

[75] Inventors: Ravi Batra, Rockaway; Pierre W. Taubenblat, Highland Park, both of N.J.

[73] Assignee: Amax Inc., Greenwich, Conn.

[21] Appl. No.: 138,803

[22] Filed: Apr. 9, 1980

[51] Int. Cl.[3] ..... C22C 9/00; C27C 9/05

[52] U.S. Cl. ..... 75/153; 75/161; 148/11.5 C; 148/32

[58] Field of Search ..... 75/153, 76, 161; 148/11.5 C, 32

[56] References Cited

U.S. PATENT DOCUMENTS

| | | | |
|---|---|---|---|
| 1,896,193 | 2/1933 | Corson | 75/162 |
| 2,038,136 | 4/1936 | Smith | 75/153 |
| 2,178,508 | 10/1939 | Zickrick | 200/266 |
| 2,206,109 | 7/1940 | Müller et al. | 75/155 |
| 2,232,960 | 2/1941 | Milnes | 136/238 |
| 3,451,808 | 6/1969 | Thielmann | 75/161 |
| 4,059,437 | 11/1977 | Nesslage et al. | 75/76 |

OTHER PUBLICATIONS

Temple, "Recent Developments in Properties and Protection of Copper for Electrical Uses", *Metallurgical Reviews*, vol., 1966, pp. 47–60.

Mendenhall, *Understanding Copper Alloys*, Olin Brass, East Alton, Illinois, 1977, pp. 64–67.

*Primary Examiner*—Peter K. Skiff

*Attorney, Agent, or Firm*—Michael A. Ciomek; Donald T. Black

[57] ABSTRACT

Copper alloys having high conductivity at room temperature and superior resistance to softening at elevated temperatures comprise oxygen-free copper containing small but effective amounts of selenium and manganese, and in particular about 4 to about 100 parts per million selenium and about 4 to about 100 parts per million manganese. The alloys can advantageously be used in place of copper-silver alloys, with a realization of improved properties and reduced cost.

22 Claims, 3 Drawing Figures

COPPER ALLOYS WITH SMALL AMOUNTS OF MANGANESE AND SELENIUM

BACKGROUND OF THE INVENTION

1. Field of the Invention

The present invention relates to copper alloys and specifically to such alloys which exhibit high strength, high softening temperatures and excellent conductivity compared to unalloyed copper.

The ability of copper to retain its strength following exposure to elevated temperatures (termed "thermal stability" herein) is an important property for many applications in which metals are used, such as rotor and stator windings, welding electrodes, heat sinks for removal of heat from electronic devices, and articles which must be assembled by soldering. Pure copper, while having exceptional conductivity, has a tendency to experience recovery, recrystallization and grain growth at elevated temperatures as low as about 150° C. which makes the pure metal unsatisfactory for many special and critical applications.

It is a well-known expedient to add various alloying elements to copper to strengthen it, but the added elements often have the undesirable effect of reducing the conductivity compared to pure copper. Alloys of copper with silver are known which exhibit desirable conductivity and good retention of strength at moderately elevated temperatures, but the high cost of the silver used to make these alloys is a drawback which limits their wider use. Thus, there is a need for copper-base compositions which exhibit higher thermal stability after exposure to elevated temperatures than copper, while exhibiting other desirable properties of copper.

2. Description of the Prior Art

While the prior art reveals that manganese and/or selenium have in the past been added to copper, there is no recognition of the very beneficial effects of adding to copper minor amounts of both manganese and selenium. For instance, U.S. Pat. No. 2,038,136 discloses adding from 0.05% to 4% selenium to copper to increase the machinability of the copper, and also discloses that the selenium-copper alloy may contain up to 0.5% manganese as an optional additive. It should be noted that the manganese and selenium contents required to improve the machinability of copper are far greater than those required by the present invention in order to improve the thermal stability of copper.

U.S. Pat. No. 4,059,437 discloses an oxygen-free copper product produced without the use of deoxidizers and containing manganese in amounts on the order of 1 to 100 ppm. The manganese is said to provide exhanced grain size control during annealing of the copper, resulting in the copper product having improved surface appearance, grain structure, and ductility after annealing, while retaining high conductivity. Other elements are disclosed as being present only in the amounts in which they normally exist in oxygen-free copper; thus, there is no suggestion of the surprisingly advantageous results of thermal stability that can be realized by incorporating both manganese and selenium into oxygen-free copper in the amounts disclosed herein.

U.S. Pat. No. 2,206,109 discloses an alloy of copper with cobalt and/or nickel, and also containing 4 to 15% manganese and up to 0.6% selenium. While this disclosure attributes improved cold workability and corrosion resistance to the manganese and selenium additives, it does not suggest a copper base alloy containing only minor amounts of manganese and selenium, and does not suggest that such an alloy would exhibit the improved properties of the present invention.

Other patents disclose adding either manganese or selenium, plus one or more other additives, to copper but fail to recognize the synergistic effect of adding both manganese and selenium in amounts within the ranges that are disclosed and claimed herein: U.S. Pat. No. 1,896,193, U.S. Pat. No. 2,178,508, U.S. Pat. No. 2,232,960, and U.S. Pat. No. 3,451,808.

SUMMARY OF THE INVENTION

Generally speaking, the present invention is directed to a cold worked copper base alloy having high electrical conductivity and improved resistance to recovery, recrystallization and grain growth at elevated temperatures. The cold worked alloy consists essentially of small but effective amounts of manganese and selenium to increase the half-hour softening temperature at least about 100° C. above that of the unalloyed copper base for a given amount of cold work while maintaining the electrical conductivity above about 100% International Annealed Copper Standard (IACS), less than about 20 ppm oxygen, and the balance essentially copper.

Cold worked copper base alloys in accordance with the present invention can be produced by establishing under non-oxidizing conditions a molten bath of copper containing less than about 20 ppm oxygen, adjusting the manganese and selenium contents of the molten copper to small but effective amounts to provide the cold worked copper alloy with a half-hour softening temperature at least about 100° C. above that of the unalloyed copper base for a given amount of cold work while maintaining the electrical conductivity above about 100% IACS, casting the molten copper alloy, hot working it, and finally cold working the alloy to its final shape.

DETAILED DESCRIPTION OF THE INVENTION

Figure 1:
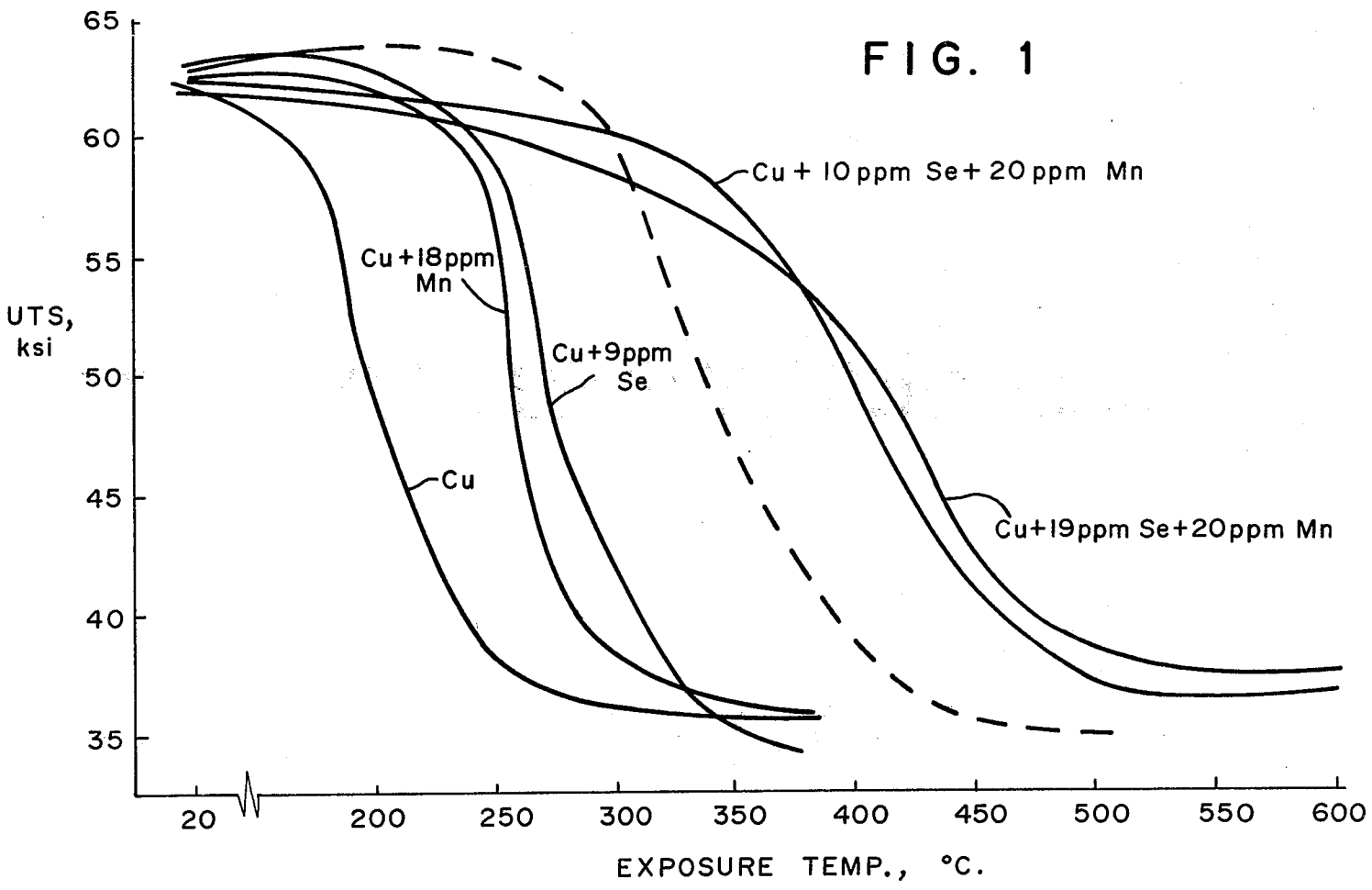
FIG. 1 is a graph showing the ultimate tensile strength at ambient temperature for six copper alloys after the alloys have been exposed to various elevated temperatures for a fixed period of time.

As indicated, the improved copper alloys of the present invention should be substantially oxygen-free, i.e. they should contain less than about 20 parts per million oxygen. This requirement can most readily be met by starting with copper which contains less than about 20 parts per million oxygen, and making the alloys under a non-oxidizing atmosphere. Copper known as "oxygen-free copper" is quite suitable for use in the practice of the present invention. That term is used by those skilled in this art to mean a high purity copper which has been substantially freed of its oxygen content by any of the known methods employed for the purpose, including melting it under a reducing atmosphere, or adding small amounts of a deoxidizing agent such as phosphorus to the molten copper and removing the oxidized agent.

Oxygen-free copper typically contains less than about 1 to 2 ppm of selenium and less than about 1 to 2 ppm of manganese.

Copper used to make the alloys of the present invention will also preferably comprise at least about 99.99% copper, and be free of substances which will react deleteriously with the selenium and manganese which are to be incorporated into the copper.

To prepare alloys according to the present invention, a molten bath of copper meeting the above description should be established at a temperature preferably between about 1100° C. and about 1250° C. under suitable non-oxidizing conditions, such as under a blanket of argon or other gas inert to the copper, manganese, and selenium. If excessive oxygen is present (in the copper or in the atmosphere over the copper) when the manganese and selenium are added to the copper base, oxidation of manganese could occur which would cause a slag to form atop the melt, or a dispersion of manganese oxide could form in the final product, while selenium could be partially eliminated from the melt as an oxide of selenium.

When the molten copper bath is established, the selenium content and the manganese content of the melt are adjusted so that the desired amount of each component is present in the melt. The adjustments of the selenium and manganese contents are most readily made by adding manganese and selenium to the melt, typically in elemental form. Conveniently, the manganese, the selenium, or both elements can be added in a master alloy in an oxygen-free copper base, to facilitate handling of the small amounts of these two elements. Even though selenium is relatively volatile at the temperature of the molten copper bath, as will be seen in Example 1 which follows, it is possible under properly controlled conditions to add selenium and manganese in elemental form to the molten copper without incurring significant losses of either component. The material added to the molten oxygen-free copper can be in either the solid or molten state, preferably the solid state; it will melt and reach a uniform distribution of the ingredients in the molten copper base in a very short time.

It has been found that the desired properties of the alloys of the present invention are particularly evident in alloys in which the selenium and manganese are each present in amounts between about 4 ppm (parts per million, by weight of the final composition) and about 100 ppm. Generally speaking, high amounts of manganese in the alloys of this invention can provide slightly lower tensile strength, whereas alloys of this invention containing higher amounts of manganese or selenium can exhibit slightly lower electrical conductivity. Thus, the alloys of the present invention advantageously have manganese and selenium contents each within the range of about 4 ppm to about 80 ppm and more advantageously about 10 ppm to about 50 ppm. As one skilled in this art will recognize, analytical methods are known through which one can determine the amounts of selenium and manganese which are present in the copper alloys of this invention.

The copper containing the desired amounts of selenium and manganese is next cast and then heated, advantageously to a temperature of about 800° C. to about 950° C. to homogenize the material, and then hot worked to break up the cast structures. The hot worked article is then allowed to cool. The solid article can then be solution annealed, to impart additional strength retention and to raise the softening temperature further. The temperature and length of time for which solution annealing is carried out vary with the size of the cast body, but should be sufficient to impart the desired properties to the alloy following cold working. In an advantageous embodiment of the present invention, the cast body is solution annealed for the equivalent of exposure to a temperature of 700° C. or above for 30 minutes. Finally, the body is cold worked to its final shape. Typically, it can be cold worked about 20% or more but additional strength can be imparted to the alloy by cold working it at least about 40%, and advantageously at least about 60% or more, and more advantageously at least about 90%.

EXAMPLE 1

Alloys within the scope of this invention were prepared having the constituents set forth in Table 1:

TABLE 1

| Alloy No. | Mn, ppm | Se, ppm | Cu |
|---|---|---|---|
| 1 | 5 | 5 | Balance |
| 2 | 8 | 7 | " |
| 3 | 20 | 4 | " |
| 4 | 20 | 10 | " |
| 5 | 24 | 7.5 | " |
| 6 | 28 | 17 | " |
| 7 | 36 | 20.5 | " |

These alloys were prepared by different methods, as follows:

Alloys 1, 2 and 6: 15 kg of copper having an oxygen content of less than 10 ppm was melted at 1250° C. in a chamber under a vacuum of 100 microns, and then the chamber was back-filled with nitrogen. Selenium and manganese were added to the melt in elemental form, and the melt was cast, hot worked 90% at 850° C., cooled to room temperature, solution annealed at 850° C. for 30 minutes (under charcoal), water quenched, and cold worked 90% to 0.081 inch-diameter wire. Manganese and selenium contents were determined by atomic absorption methods.

Alloy 3: this procedure differed from that used for Alloys 1, 2 and 6 only in that the selenium was added as $Cu_2Se$.

Alloy 4: this procedure differed from that used for Alloys 1, 2 and 6 only in that the manganese and selenium were added as a Cu-0.5% Se-1% Mn master alloy.

Alloys 5, 7: this procedure differed from that used for alloys 1, 2 and 6 only in that 1 kg of copper was melted under argon or nitrogen at atmospheric pressure, and then the elemental manganese and selenium were added.

Surprisingly, the presence of small amounts of both manganese and selenium in the copper body has a markedly improved effect on the softening temperature of the alloy. Generally speaking, exposure of the alloys of this invention to an elevated temperature on the order of 300° C. to 500° C. results in a much smaller loss of strength than is experienced when copper or copper-silver alloys, or copper containing only manganese or only selenium, are exposed to similar temperatures.

For purposes of comparison, the loss of strength on exposure is elevated temperaure of alloys of the present invention and of other tested materials was determined by exposing a sample of material to a given exposure temperature for 30 minutes, allowing it to cool back to ambient temperature, and then determining the ultimate tensile strength by test means familiar in the art. The ultimate tensile strength value (UTS) was then plotted against the exposure temperature, and the plotted points for samples of a given composition were connected to generate characteristically shaped softening curves having a first region in which strength is lost only gradually as the exposure temperature rises above room temperature, and a second region in which strength is lost at a more pronounced rate with increasing exposure temperature.

"Half-hour softening temperature", discussed in this specification and the attached claims to characterize the inventive compositions and to compare them to other compositions, is that temperature at which a material has softened to an ultimate tensile strength value halfway between its ultimate tensile strength prior to exposure to a higher temperature, and its ultimate tensile strength when it has become fully softened as a result of exposing the alloy to elevated temperature for half an hour. As will be apparent to those skilled in this art, an increased half-hour softening temperature indicates increased retention of strength and resistance to recovery, recrystallization and grain growth.

The copper base alloys within the scope of this invention having a given amount of cold work exhibit half-hour softening temperatures at least about 100° C. higher than the half-hour softening temperature of the unalloyed copper base having the same amount of cold work. That is, compared to the half-hour softening temperature of the oxygen-free copper that serves as the base for the alloys of the present invention, for a given amount of cold work, the half-hour softening temperature is increased at least about 100° C. by alloying the oxygen-free copper with manganese and selenium under the conditions described herein and applying the same amount of cold work. Advantageously, alloys of the present invention contain amounts of manganese and selenium effective to increase the half-hour softening temperature at least about 150° C. above that of the unalloyed copper base, for a given amount of cold work, and exhibit even greater strength retention.

The increase in half-hour softening temperature afforded by the present invention is demonstrated in the following example.

EXAMPLE 2

Samples of alloys according to the present invention, and samples of other material to be compared to the present invention, were cast, hot worked 90% at 850° C., solution annealed at 850° C. for 30 minutes, and then cold worked 90% to 0.081-inch diameter wire.

FIG. 1 contains the softening curves for six different alloys after exposure for half an hour to exposure temperature ranging from 20° C. to 500° C. (1 ksi = 1000 lbs/sq. in). The three curves in FIG. 1 which are grouped toward the left depict the change in strength with exposure temperature for three reference alloys: unalloyed oxygen-free copper, sold by Amax Copper, Inc. Under the trademark "OFHC"; OFHC copper also containing 9 parts per million selenium, and containing less than 0.5 ppm manganese; and OFHC copper also containing 18 parts per million manganese, and containing less than 0.5 ppm selenium. The curve represented by dashed lines depicts the softening behavior of OFHC copper also containing 33 ounces of silver per ton of alloy, or about 1000 parts per million silver.

The two curves farthest to the right in FIG. 1 depict the softening behavior of two alloys within the scope of the present invention: OFHC copper containing 20 ppm manganese and 10 ppm selenium; and OFHC copper containing 20 ppm manganese and 20 ppm selenium.

As can be seen in FIG. 1, after half-hour exposures to temperatures up to about 200° C. the alloys of the present invention exhibit room-temperature ultimate tensile strengths comparable to those of the reference alloys. Whereas the room-temperature ultimate tensile strengths of these reference alloys decrease significantly after exposure to temperatures above about 200° C., the tested alloys within the scope of the present invention exhibit significant strength retention even after exposure to temperatures in excess of 400° C. The half-hour softening temperatures of the two compositions of the present invention depicted in FIG. 1 are significantly over 350° C., and are more than 100° C. higher than the half-hour softening temperature of the unalloyed oxygen-free copper.

FIG. 1 also illustrates that the alloys of the present invention possess comparable or higher room-temperature tensile strengths after exposure to high temperatures compared to a conventional copper-silver alloy. The tensile strength of the particular copper-silver alloy described in FIG. 1 drops off above about 350° C.; after exposure to 400° C., the room-temperature ultimate tensile strengths of the present invention are far above that of the copper-silver alloy. Indeed, alloys within the scope of this invention surpass the copper-silver alloy in strength after exposure to temperatures up to about 500° C.

Figure 2:
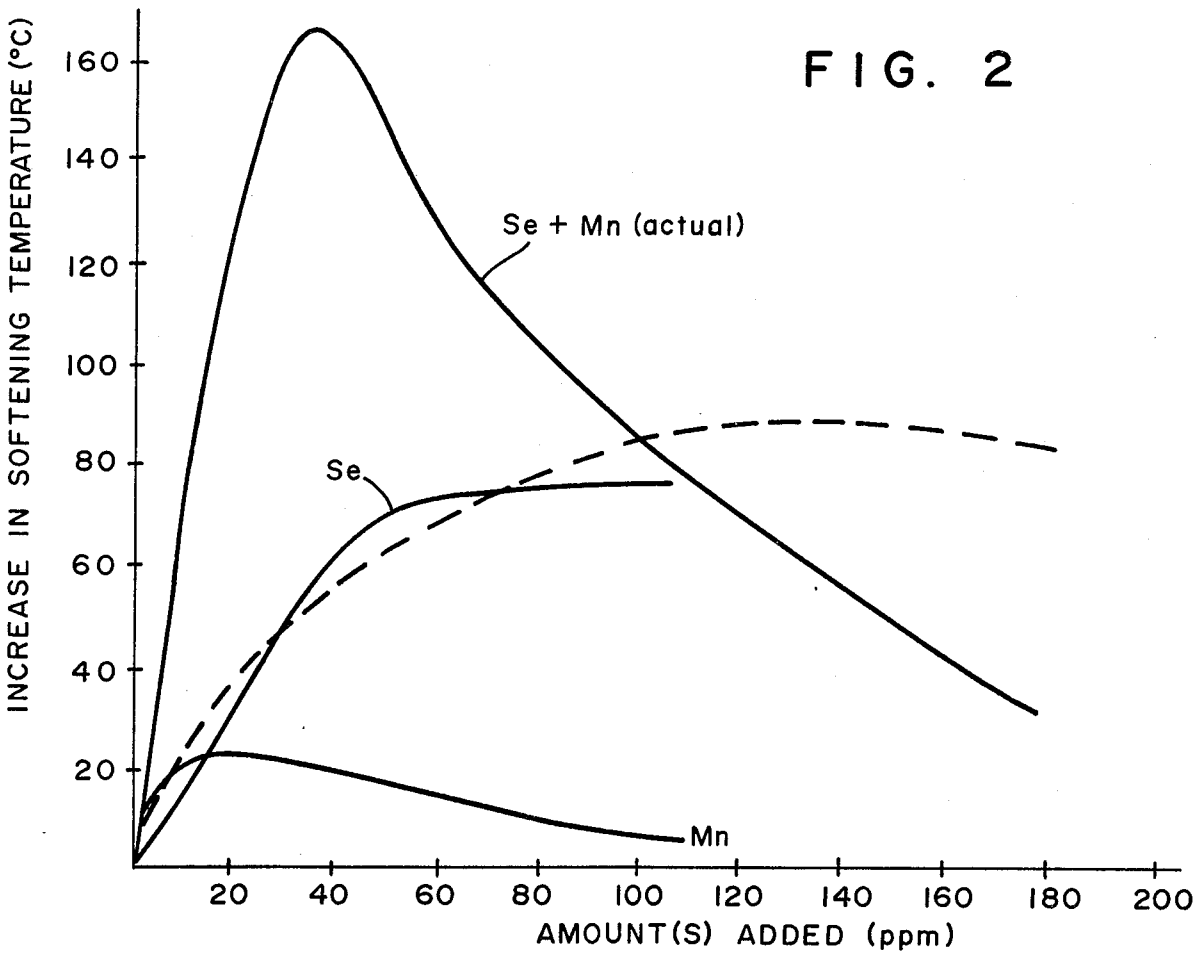
FIG. 2 is a graph of the increase in half-hour softening temperature over that of unalloyed oxygen-free copper for several different alloys of copper with Mn, Se, or both, plotted against the Mn and/or Se content of the alloy.

The synergistic effect of the presence of both the elements added to copper in accordance with the present invention should also be noted. The strong influence that combinations of manganese and selenium have on raising the softening (recrystallization) temperature of copper may be further seen in FIG. 2. The curves labeled "Mn" and "Se" show the increases in half-hour softening temperature due to separate additions of manganese and selenium to oxygen-free copper. It is apparent that additions of up to 100 ppm of Mn alone or Se alone result in a maximum softening temperature increase above oxygen-free copper of about 25° C. for manganese alone and about 75° C. for selenium alone. The dashed line in FIG. 2 depicts the sum of the increases in half-hour softening temperature provided by the separate additions of equal amounts of manganese or selenium, plotted against total content of manganse and selenium. This line represents the increased half-hour softening temperature which one might expect on alloying oxygen-free copper with equal amounts of manganese and selenium. Viewing the dashed line, it is seen that if manganse and selenium were added up to a total of 100 ppm, a maximum half-hour softening temperature increase of perhaps 90° C. might be predicted based on a superposition of the separate influences of manganse and selenium. In actuality, however, as can be seen in the line labeled "Se + Mn (actual)", the combination of manganese and selenium in oxygen-free copper yielded an unexpected increase in softening temperature of up to about 170° C., demonstrating the beneficial synergistic interaction between manganese and selenium. All the data plotted in FIG. 2 were obtained using alloys that had been cold worked 90%.

As further evidence of the superior properties of the alloys of this invention, it has been determined that the inventive alloys exhibit surprisingly high ductility when subjected to a standard ductility test. For example, oxygen-free copper containing 20 ppm selenium and 20 ppm manganese was hot worked 90%, solution annealed 30minutes at 850° C., cold worked 90%, and annealed in $H_2$ at 850° C. This sample could be bent without breaking 11 times in a reverse bend test in accordance with ASTM Specification B-170. This result is, surprisingly, comparable to the 11 reverse bends to which a typical sample of pure OFHC copper can be subjected in the same test before breaking.

The alloys of the present invention exhibit surprising high-temperature strength retention as discussed above, while also possessing very favorable electrical conductivity compared to the conductivity of pure copper. Specifically, conductivity exceeding 100% International Annealed Copper Standard (IACS) can readily be obtained. This fact means that the new alloys are highly useful in applications requiring high conductivity as well as good thermal stability. The following table gives conductivity data for OFHC copper and for several alloys which are within the scope of the present invention:

TABLE 2

| Composition | | | Conductivity |
|---|---|---|---|
| Mn, ppm | Se, ppm | Cu | % IACS |
| — | — | OFHC | 101.50 |
| 5 | 5 | Balance | 101.05 |
| 8 | 7 | " | 101.10 |
| 20 | 10 | " | 100.75 |
| 20 | 20 | " | 100.90 |
| 24 | 7.5 | " | 100.75 |
| 28 | 17 | " | 100.85 |
| 36 | 20.5 | " | 100.90 |

Figure 3:
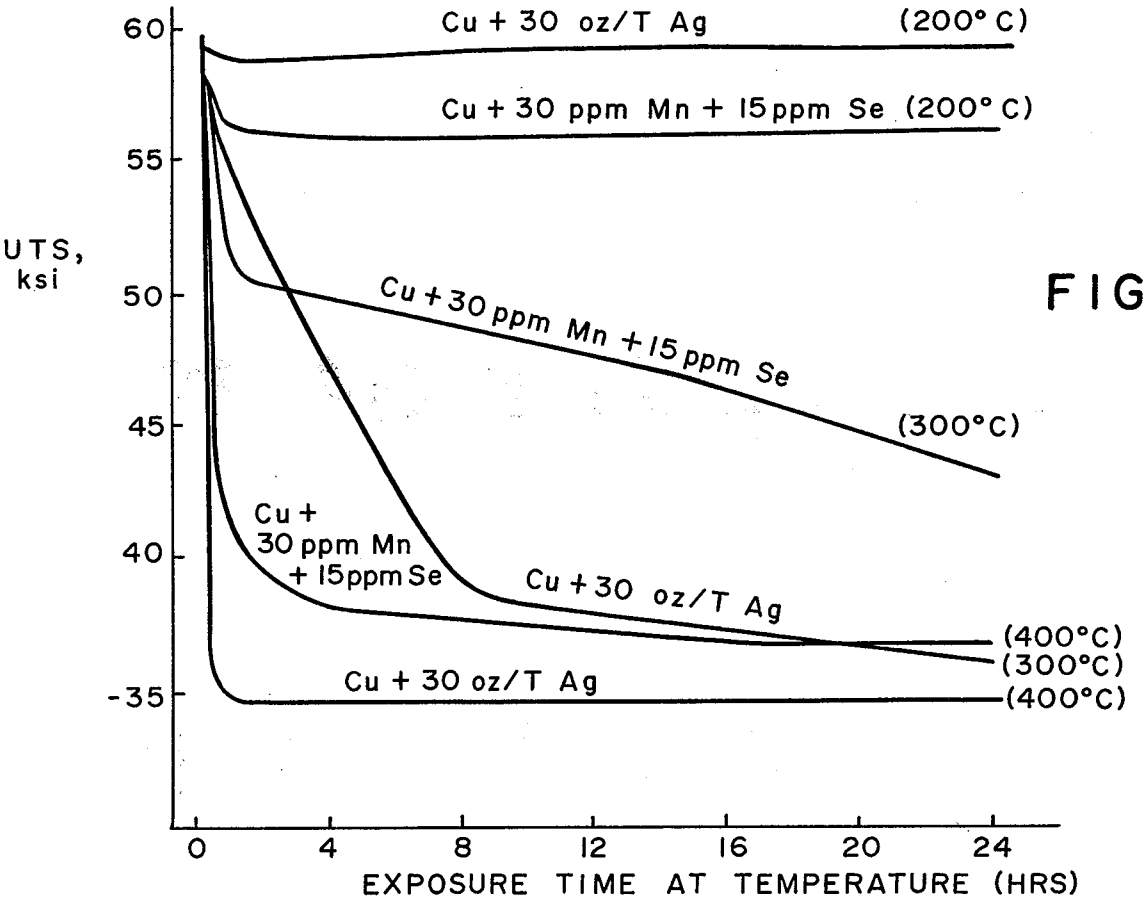
FIG. 3 is a graph of the ultimate tensile strength of several copper alloys following exposure to various temperatures, plotted against the time of exposure to a particular temperature.

It has also been determined that the alloys of the present invention exhibit surprisingly improved strength retention after exposure to elevated temperatures for periods of time longer than 30 minutes, e.g. an hour or several hours. FIG. 3 shows the effect of increasing time of exposure to elevated temperature for alloys within the scope of the present invention, containing 30 ppm manganese and 15 ppm selenium in an oxygen-free copper base, and for a copper-silver alloy containing 30 ounces of silver per ton in an oxygen-free copper base. All samples tested had been cold worked 90%.

On exposure to 300° C., the copper-silver alloys appears to retain slightly more strength than the copper-manganese-selenium alloy for exposure times up to about 3 hours. For exposure times longer than 3 hours, such as up to 24 hours or longer, the alloy of this invention retains considerably higher ultimate tensile strength.

On exposure of 400° C., the copper-silver alloy is fully softened to about 35 ksi in about half an hour, whereas the copper-manganese-selenium alloy still has a room-temperature strength of about 45 ksi. Furthermore, the room-temperature ultimate tensile strength in a fully softened condition is higher for the alloy of the present invention than for the copper-silver alloy.

It has also been determined that the present invention exhibits surprisingly advantageous properties compared to oxygen-free copper alloyed with manganese and sulfur, or manganese and tellurium. Table 3 contains ultimate tensile strength ("UTS", in ksi), yield strength ("YS", in ksi), and elongation ("Elong.", in %), measured at room temperature following exposure to either 300° C. or 350° C. for 30 minutes for alloys that were cold worked 90% with and without solution annealing prior to cold working. The alloys contained oxygen-free copper and: Sulfur alone; Selenium alone; Tellurium alone; Manganese plus Sulfur; Manganese plus Selenium; and Manganese plus Tellurium. As can be seen, the alloys containing Manganese plus Selenium exhibit properties which are significantly and unexpectedly superior to the properties exhibited by the other alloys.

TABLE 3

| Element, ppm | | | | No Solution Anneal, 90% Cold Work | | | | | | Solution Anneal and 90% Cold Work | | | | | |
|---|---|---|---|---|---|---|---|---|---|---|---|---|---|---|---|
| | | | | 300° C., 30-min. | | | 350° C., 30-min. | | | 300° C., 30-min. | | | 350° C., 30-min. | | |
| Mn | S | Se | Te | UTS | YS | Elong. | UTS | YS | Elong. | UTS | YS | Elong. | UTS | YS | Elong. |
| 00.1 | 13 | — | <2 | 35.7 | 18.4 | 38.6 | 35.7 | 14.2 | 42.0 | 47.0 | 38.4 | 16.4 | 36.5 | 11.1 | 43.3 |
| — | — | 25.4 | — | 37.1 | 11.1 | 43.3 | 36.8 | 11.2 | 37.9 | 36.6 | 11.7 | 46.7 | 37.7 | 11.5 | 46.0 |
| — | — | — | 46 | 34.1 | 20.9 | 34.1 | 34.1 | 18.2 | 39.7 | 48.9 | 40.5 | 17.4 | 42.2 | 26.9 | 27.1 |
| 13.8 | 12 | — | — | 35.7 | 15.3 | 36.8 | 35.9 | 12.5 | 41.6 | 37.7 | 16.6 | 38.0 | 36.4 | 9.8 | 44.6 |
| 13.8 | — | — | 54 | 37.4 | 27.1 | 27.8 | 35.6 | 21.6 | 31.5 | 47.7 | 38.6 | 19.9 | 41.9 | 27.6 | 27.3 |
| 34 | — | 26.4 | — | 56.9 | 51.6 | 11.1 | 53.2 | 46.9 | 13.3 | 61.8 | 58.0 | 9.3 | 60.5 | 56.9 | 10.3 |
| 57 | — | 31.6 | — | 50.9 | 44.8 | 13.4 | 46.7 | 37.7 | 21.2 | 58.6 | 54.8 | 8.7 | 59.2 | 55.5 | 9.3 |

We claim:

1. A cold worked copper-base alloy having high electrical conductivity and improved resistance to recovery, recrystallization and grain growth at elevated temperatures consisting essentially of small but effective amounts of manganese and selenium to increase the half-hour softening temperature of the cold worked alloy at least about 100° C. above that of the unalloyed copper base for a given amount of cold work while maintaining the electrical conductivity above about 100% International Annealed Copper Standard (IACS), less than about 20 ppm oxygen, and the balance essentially copper.

2. The cold worked copper-base alloy according to claim 1 wherein manganese and selenium are present in amounts effective to increase the half-hour softening temperature of the cold worked alloy at least about 150° C. above that of the unalloyed copper base for a given amount of cold work.

3. A cold worked copper-base alloy having an electrical conductivity above about 100% International Annealed Copper Standard (IACS) and improved resistance to recovery, recrystallization and grain growth at elevated temperatures consisting essentially of from about 4 to about 100 ppm manganese, about 4 to about 100 ppm selenium, less than about 20 ppm oxygen, and the balance essentially copper.

4. The cold worked copper-base alloy according to claim 3 wherein the manganese content is about 4 to about 80 ppm and the selenium content is about 4 to about 80 ppm.

5. The cold worked copper-base alloy according to claim 3 wherein the manganese content is about 4 tc about 50 ppm and the selenium content is about 4 tc about 50 ppm.

6. The cold worked copper-base alloy according to claim 3, 4 or 5 wherein the half-hour softening temperature of the cold worked alloy is at least about 100° C. above that of the unalloyed copper base for a given amount of cold work.

7. The cold worked copper-base alloy according to claim 6 wherein the half-hour softening temperature of the cold worked alloy is at least about 150° C. above that of the unalloyed copper base for a given amount of cold work.

8. A process for producing a cold worked copper-base alloy having high electrical conductivity and improved resistance to recovery, recrystallization and grain growth at elevated temperatures comprising establishing under non-oxidizing conditions a molten bath of copper containing less than about 20 ppm oxygen, adjusting the manganese and selenium contents of the molten copper to small but effective amounts to increase the half-hour softening temperature of the cold worked alloy at least about 100° C. above that of the unalloyed copper base for a given amount of cold work and to provide the alloy with an electrical conductivity above about 100% IACS, casting the molten copper alloy, hot working it, and finally cold working the alloy to its final shape.

9. The process according to claim 8 wherein the manganese and selenium contents are adjusted to increase the half-hour softening temperature of the cold worked alloy at least about 150° C. above that of the unalloyed copper base for a given amount of cold work.

10. A process for producing a cold worked copper-base alloy having an electrical conductivity above about 100% International Annealed Copper Standard (IACS) and improved resistance to recovery, recrystallization and grain growth at elevated temperatures comprising establishing under non-oxidizing conditions a molten bath of copper containing less than about 20 ppm oxygen, adjusting the manganese content to between about 4 and about 100 ppm manganese, adjusting the selenium content to between about 4 and about 100 ppm selenium, casting the molten copper alloy, hot working it, and finally cold working the alloy to its final shape.

11. The process according to claim 10 wherein the manganese content is adjusted to about 4 to about 80 ppm and the selenium content is adjusted to about 4 to about 80 ppm.

12. The process according to claim 10 wherein the manganese content is adjusted to about 4 to about 50 ppm and the selenium content is adjusted to about 4 to about 80 ppm.

13. The process according to claim 10, 11 or 12 wherein the half-hour softening temperature of the cold worked alloy is at least about 100° C. above that of the unalloyed copper base for a given amount of cold work.

14. The process according to claim 13 wherein the half-hour softening temperature of the alloy is at least about 150° C. above that of the unalloyed copper base for a given amount of cold work.

15. A cold worked copper-base alloy having high electrical conductivity and improved resistance to recovery, recrystallization and grain growth at elevated temperature consisting essentially of small but effective amounts of manganese and selenium to provide the alloy with a half-hour softening temperature of at least about 350° C. when the alloy is cold worked 90%, while maintaining the electrical conductivity above about 100% International Annealed Copper Standard (IACS), less than about 20 ppm oxygen, and the balance essentially copper.

16. The cold worked copper-base alloy according to claim 15 wherein manganese and selenium are present in amounts effective to provide the alloy with a half-hour softening temperature of at least about 400° C. when the alloy is cold worked 90%.

17. The cold worked copper-base alloy of claim 15 or claim 16 wherein the manganese content is about 4 to about 100 ppm and the selenium content is about 4 to about 100 ppm.

18. The cold worked copper-base alloy of claim 17 wherein the manganese content is about 4 to about 50 ppm and the selenium content is about 4 to about 50 ppm.

19. A process for producing a cold worked copper-base alloy having high electrical conductivity and improved resistance to recovery, recrystallization and grain growth at elevated temperatures comprising establishing under non-oxidizing conditions a molten bath of copper containing less than about 20 ppm oxygen, adjusting the manganese and selenium contents of the molten copper to small but effective amounts to provide the alloy with a half-hour softening temperature of at least about 350° C. when the alloy is cold worked 90% and to provide the alloy with an electrical conductivity above about 100% IACS, casting the molten copper alloy, hot working it, and finally cold working the alloy to its final shape.

20. The process according to claim 19 wherein the manganese and selenium contents are adjusted to provide the alloy with a half-hour softening temperature of at least about 400° C. when the alloy is cold worked 90%.

21. The process of claim 19 or claim 20 wherein the manganese content is adjusted to about 4 to about 100 ppm, and the selenium content is adjusted to about 4 to about 100 ppm.

22. The process of claim 21 wherein the manganese content is adjusted to about 4 to about 50 ppm, and the selenium content is adjusted to about 4 to about 50 ppm.

* * * * *